US006577218B2

(12) United States Patent
Hamatani et al.

(10) Patent No.: US 6,577,218 B2
(45) Date of Patent: Jun. 10, 2003

(54) ELECTRONIC COMPONENT AND METHOD OF MANUFACTURING SAME

(75) Inventors: Junichi Hamatani, Matsumoto (JP); Hisato Oshima, Takefu (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/985,144

(22) Filed: Nov. 1, 2001

(65) Prior Publication Data

US 2002/0110958 A1 Aug. 15, 2002

(30) Foreign Application Priority Data

Nov. 1, 2000 (JP) ..... 2000-334260

(51) Int. Cl.[7] ..... H01F 27/02
(52) U.S. Cl. ..... 336/83; 336/83
(58) Field of Search ..... 336/83, 200, 223, 336/232, 90, 96; 29/602.1, 60

(56) References Cited

U.S. PATENT DOCUMENTS 6,154,112 A * 11/2000 Aoba et al. ..... 336/192
6,348,850 B1 * 2/2002 Kimura et al. ..... 336/200
6,377,151 B1 * 4/2002 Takayama et al. ..... 336/83
6,393,691 B1 * 5/2002 Ogawa et al. ..... 29/602.1
6,449,830 B1 * 9/2002 Amada et al. ..... 29/605

* cited by examiner

*Primary Examiner*—Anh Mai
(74) *Attorney, Agent, or Firm*—Keating & Bennett, LLP

(57) ABSTRACT

An electronic component includes an internal conductor (conductor coil) made of a metal that is embedded in a molded body. The molded body is formed by molding a ferrite resin into a fixed shape, such that at least a portion of the internal conductor is exposed on the surface of the molded body, and external electrodes, which are connected to the internal conductor, are provided in a fixed area, including the exposed portion of the internal conductor, on the surface of the molded body. The electronic component is manufactured by depositing palladium at a density of about 0.5 $\mu g/cm^2$ to about 1.5 $\mu g/cm^2$ in the area in which the internal conductor is not exposed on the molded body, and at a density of about 0.05 $\mu g/cm^2$ to about 0.3 $\mu g/cm^2$ on the internal conductor exposed on the surface of the molded body. The external electrodes are formed via a process of forming a metal film (electroless plating film) on the surface of the molded body by conducting electroless plating.

9 Claims, 5 Drawing Sheets

ELECTRONIC COMPONENT AND METHOD OF MANUFACTURING SAME

BACKGROUND OF THE INVENTION

1. Field of the Invention

The present invention relates to an electronic component and a manufacturing method for the electronic component, and more particularly to an electronic component having including external electrodes connected to an internal conductor and provided on the surface of a molded body having the internal conductor embedded therein and a manufacturing method for the electronic component.

2. Description of the Related Art

One electronic component, as shown in FIG. 10, is a surface mounting type inductor in which a pair of external electrodes 54*a* and 54*b* are electrically connected to end portions 52*a* and 52*b* of a conductor coil 52, on the surface of a molded body 53 arranged such that the coil conductor (internal conductor) 52 is embedded in a magnetic material 51 having a resin or rubber mixed with a magnetic powder and kneaded such that they are configured in a fixed shape. Conventionally, such an inductor is manufactured by a method described below.

Step 1

First, a molded body is formed, in which an air-core coil (internal conductor) defined by a wound copper wire is embedded in a resin or rubber mixed with a magnetic powder and kneaded such that both end portions of the air-core coil are exposed.

Step 2

Next, the surface of the molded body including the exposed portions of the air-core coil (internal conductor) is cleaned with alcohol or a neutral degreasing agent, and then etched to roughen the surface using an acidic or alkaline solution.

Step 3

Then, after the molded body has been immersed in a solution containing palladium ions, the palladium ions are reduced with a reducing agent to cause the metal palladium nuclei to precipitate onto the surface of the molded body.

Step 4

Next, electroless nickel plating is performed to form a metal film on the entire surface of the molded body.

Step 5

Then, after a necessary portion of the metal film has been coated with a resist, etching is performed to remove unnecessary portions of the metal film.

Step 6

Next, the resist is removed and various electroplating processes are performed on the metal film to form the external electrodes.

In this way, a surface mounting type inductor as shown in FIG. 10 is obtained.

However, when a metal film is formed by electroless plating, after the molded body is immersed in a solution containing palladium ions, the palladium ions on the molded body are reduced with a reducing agent, and then a palladium catalyst is provided on the surface of the molded body by precipitating the metal palladium nuclei, the adherence of a metal film provided on the surface of the molded body is affected by the adhesion of palladium nuclei, and thus, it is difficult to form a metal film having good adherence to both the surface of the molded body, which is made of a magnetic material having a resin or rubber as the main component, and is hereinafter, simply referred to as the molded body's surface and the exposed surface of the internal conductor, which is hereinafter, simply referred to as the internal conductor's exposed surface. Accordingly, to improve the adherence to both the molded body's surface and the internal conductor's exposed surface, strict control of the concentration and viscosity of a solution containing palladium ions and the conditions for electroless plating is required, which greatly increases to cost of producing the surface mounting type inductor.

SUMMARY OF THE INVENTION

To overcome the above-described problems, preferred embodiments of the present invention provide an electronic component including external electrodes having excellent adherence to both the molded body's surface and the internal conductor's exposed surface and having a greatly improved reliability and a manufacturing method for the electronic component.

The inventors have researched and investigated the relationship between the density of palladium deposited on the surface of the molded body and the adhesion of the electroless plating films. It was discovered that, in the method of electroless plating using palladium as a catalyst, 1) when palladium is densely deposited, the adhesion between a metal film formed by electroless plating and a molded body, preferably made of magnetic material including a resin or rubber as the main component, is good, but the adhesion between a metal film and the exposed portion of an internal conductor, preferably made of metal, is insufficient, and 2) on the contrary, when palladium is thinly deposited, the adhesion between a metal film formed by electroless plating and the exposed portion of an internal conductor, preferably made of metal, is good, but the adhesion between a metal film and a molded body, preferably made of magnetic material containing a resin or rubber as the main component, is insufficient. Furthermore, the inventors have conducted experiments on and investigated the relationship between the density of palladium deposited on the surface of a molded body preferably made of a magnetic material containing a resin or rubber as the main component, referred to as the molded body's surface, and on the surface of the internal conductor exposed at the molded body, referred to as the internal conductor's exposed surface, and the adhesion of an electroless plating film, which led the inventors to the present invention.

An electronic component according to preferred embodiments of the present invention includes an internal conductor made of a metal embedded in a molded body formed by molding an insulative material including a resin or rubber as the main component into a desired shape such that at least a portion of the internal conductor is exposed on the surface of the molded body, and external electrodes are connected to the internal conductor and are provided in a desired area, including the area where the internal conductor is exposed, on the surface of the molded body, and palladium is deposited at a deposition density of about 0.5 $\mu g/cm^2$ to about 1.5 $\mu g/cm^2$ on the surface of the molded body where the external electrodes are provided except at the area the internal conductor is exposed, palladium is deposited at a deposition density of about 0.05 $\mu g/cm^2$ to about 0.3 $\mu g/cm^2$ on the internal conductor exposed at the surface of the molded body, and a metal film, that defines at least a portion of the external electrode, is formed by electroless plating in the area where the palladium is deposited.

In the electronic component according to preferred embodiments of the present invention, palladium is deposited at a deposition density of about 0.5 $\mu g/cm^2$ to about 1.5 $\mu g/cm^2$ in the area where the internal conductor is not exposed within the area where the external electrodes are provided on the surface of the molded body, palladium is deposited at a density of about 0.05 $\mu g/cm^2$ to about 0.3 $\mu g/cm^2$ on the internal conductor exposed at the surface of the molded body, and a metal film, defining at least a portion of the external electrodes, is provided in the area where the palladium is deposited at a fixed density, which includes the molded body's surface and internal conductor's exposed surface. Accordingly, an electronic component having excellent adhesion between the metal film and both the molded body's surface and the internal conductor's exposed surface is provided, and a greatly improved external connection via the external electrodes is obtained.

That is, although the adhesion of a metal film to the molded body's surface and the internal conductor's exposed surface is affected by the density of deposited palladium (deposition per unit area), when the density of deposited palladium is within the above-described range, that is, a density of about 0.5 $\mu g/cm^2$ to about 1.5 $\mu g/cm^2$ on the molded body's surface, and a density of about 0.05 $\mu g/cm^2$ to about 0.3 $\mu g/cm^2$ on the internal conductor's exposed surface, it is possible to form a metal film which has excellent adhesion to both the molded body's surface and the internal conductor's exposed surface.

Furthermore, in an electronic component according to preferred embodiments of the present invention, both end portions of the internal conductor are exposed on the surface of the molded body and a pair of external electrodes is provided so as to be electrically connected to the both end portions.

Various preferred embodiments of the present invention are applicable to, for example, a surface mounting type inductor including a pair of external electrodes that are connected to both end portions of a conductor coil on the surface of a molded body formed such that the coil conductor (internal conductor) is embedded in a magnetic material having a resin or rubber mixed with magnetic powder and kneaded to produce a fixed shape. In this case, a metal film having excellent adhesion to both the molded body's surface and the internal conductor's exposed surface is provided. Thus, a highly reliable electronic component such as an inductor is provided.

Furthermore, in an electronic component according to a preferred embodiment of the present invention, the insulative material includes a resin or rubber that is mixed with a magnetic power and kneaded.

The present invention may also be applied to the case in which the insulative material includes a resin or rubber that is mixed with a magnetic powder and kneaded, and in this case a highly reliable electronic component, such as an inductor, having excellent adhesion between the external electrodes and the molded body, is provided.

Furthermore, in an electronic component according to a preferred embodiment of the present invention, the internal conductor includes a coil conductor defined by a spirally wound metal wire.

By applying various preferred embodiments of the present invention to, for example, a surface mounting type inductor, wherein external electrodes are provided on the surface of a molded body in which a coil conductor, that is, a spirally wound metal wire defining an internal conductor, a highly reliable electronic component having excellent adhesion between a metal film defining external electrodes and a molded body is produced.

Furthermore, in an electronic component according to a preferred embodiment of the present invention, the internal conductor is preferably made of at least one material selected from a group of Cu, Ag, Al, Ni, and their alloys.

Additionally, a manufacturing method of an electronic component according to the present invention includes the steps of embedding an internal conductor made of a metal in a molded body formed by molding an insulative material having a resin or rubber as the main component into a desired shape such that at least a portion of the internal conductor is exposed on the surface the molded body, depositing palladium on the surface of the molded body at a deposition density of about 0.5 $\mu g/cm^2$ to about 1.5 $\mu g/cm^2$ where the internal conductor is not exposed, and on the internal conductor exposed on the surface of the molded body at a deposition density of about 0.05 $\mu g/cm^2$ to about 0.3 $\mu g/cm^2$, forming a metal film on the surface of the molded body via electroless plating after deposition, and providing external electrodes, which are electrically connected to the internal conductor, in a desired area, including the area where the internal conductor is exposed, on the surface of the molded body.

After palladium has been deposited at a density of about 0.5 $\mu g/cm^2$ to about 1.5 $\mu g/cm^2$ in the area (molded body's surface), in which the internal conductor is not exposed, on the molded body and palladium has been deposited at a density of about 0.05 $\mu g/cm^2$ to about 0.3 $\mu g/cm^2$ on the surface (internal conductor's exposed surface) of the internal conductor exposed at the molded body, a metal film having excellent adhesion to both the molded body's surface and the internal conductor's exposed surface by conducting electroless plating is produced. Accordingly, a highly reliable electronic component is efficiently manufactured.

Moreover, where a metal film is formed on the surface of the molded body, when the deposition of palladium on the molded body's surface is less than about 0.5 $\mu g/cm^2$, the adhesion between the molded body's surface and the metal film greatly decreases, and furthermore, when the deposition of palladium on the molded body's surface exceeds about 1.5 $\mu g/cm^2$, the segregation of palladium nuclei in the electroless plating solution greatly increases, thus causing the electroless plating solution to deteriorate and the cost to greatly increase. Accordingly, the deposition of palladium on the molded body's surface is preferably within the range of about 0.5 $\mu g/cm^2$ to about 1.5 $\mu g/cm^2$.

Furthermore, when the deposition of palladium on the internal conductor's exposed surface exceeds about 0.3 $\mu g/cm^2$, where a metal film is provided on the internal conductor's exposed surface by a method of electroless plating, the adhesion between the internal conductor's exposed surface and the metal film deteriorates, and moreover, when the deposition of palladium on the internal conductor's exposed surface is less than about 0.05 $\mu g/cm^2$, the electroless plating is only partially conductive. Accordingly, it is preferable to set the deposition of palladium on the internal conductor's exposed surface in the range of about 0.05 $\mu g/cm^2$ to about 0.3 $\mu g/cm^2$.

Furthermore, a manufacturing method for an electronic component according to a preferred embodiment of the present invention further includes the steps of roughening a predetermined area on the surface of the molded body, including the exposed portion of the internal conductor, by dry blasting, smoothing the exposed surface of the internal conductor, which is roughened by dry blasting, by immersing the molded body in an etching solution, and forming a metal film on the surface of the molded body including the exposed portion of the internal conductor by performing electroless plating after the smoothing process.

A metal film having excellent adhesion to both the molded body's surface and the internal conductor's exposed surface is provided by performing electroless plating after a fixed area on the surface of the molded body, including the exposed portion of the internal conductor, has been roughened by dry blasting, and then the exposed surface of the internal conductor is smoothed by immersing the molded body in an etching solution.

That is, the rate at which a palladium ion is reduced to metal palladium is low on the exposed surface of the internal conductor made of a metal, such as copper, having a greater ionization tendency than that of the palladium, and since the molded body's surface is much rougher than the smoothed internal conductor's exposed surface, palladium ions are more densely deposited on the molded body's surface than on the internal conductor's exposed surface because of the anchor effect. Therefore, by reducing the palladium ions deposited on the molded body's surface using a reducing agent, the deposition of palladium on the molded body's surface is much denser than the deposition of palladium on the internal conductor's exposed surface. In the electroless plating process subsequently performed, an electroless plating film having excellent adhesion to both the molded body's surface and the internal conductor's exposed surface is efficiently produced.

Furthermore, a manufacturing method for an electronic component according to a preferred embodiment of the present invention further includes the steps of roughening only the surface of the molded body by immersing the molded body in an organic solvent, and thereafter forming a metal film in a desired area on the surface of the molded body, including the exposed portion of the internal conductor, by performing electroless plating.

By conducting electroless plating after only the surface of the molded body has been roughened by immersing the molded body in an organic solvent, the deposition of palladium on the molded body's surface is denser than the deposition of palladium on the internal conductor's exposed surface. Accordingly, a metal film having excellent adhesion to both the molded body's surface and the internal conductor's exposed surface in a fixed area on the surface of the molded body including the exposed portion of the internal conductor is efficiently produced.

Other features, elements, steps, characteristics and advantages of the present invention will become apparent from the following detailed description of preferred embodiments with reference to the attached drawings.

DETAILED DESCRIPTION OF PREFERRED EMBODIMENTS

Hereinafter, preferred embodiments of the present invention are described with reference to the drawings.

In a first preferred embodiment of the present invention, a surface mounting type inductor including external electrodes 4*a* and 4*b* connected to both end portions 2*a* and 2*b* of a copper wire coil (internal conductor) 2 that functions as an inductance element are provided at both end portions of a molded body 3 including a magnetic material (ferrite resin) 1 with the copper wire coil embedded therein is produced.

Figure 1:
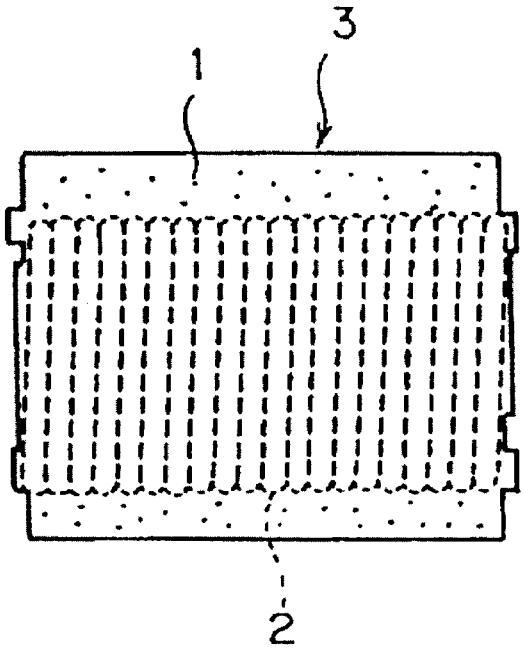
FIG. 1 shows a molded body used in a manufacturing method for an electronic component according to a first preferred embodiment of the present invention.

First, as shown in FIG. 1, a molded body 3 measuring, for example, approximately 4.5 mm×3.2 mm×3.2 mm, wherein a copper wire coil 2 having a wire diameter of, for example, approximately 0.2 mm, a coil inner diameter of, for example, about 1.8 mm, and a coil length of, for example, about 3.2 mm is embedded inside the ferrite resin (magnetic core) 1 in which ferrite powder consisting of $Fe_2O_3$, NiO, CuO, and ZnO and a PPS (polyphenylene sulfide) resin are mixed and kneaded, is prepared.

Figure 2:
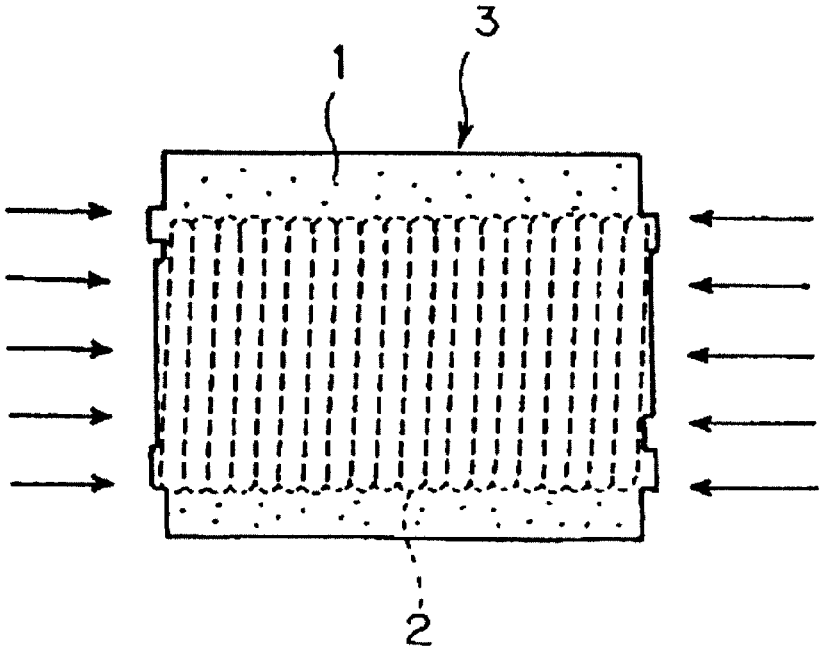
FIG. 2 shows the state in which the molded body is dry blasted in one process step in the manufacturing method for an electronic component according to the first preferred embodiment of the present invention.

Next, as shown in FIG. 2, the molded body 3 is sandblasted (dry blasted) to roughen its surface with blasting powder (alumina powder having an average particle diameter of about 40 $\mu$m is preferably used in this preferred embodiment) that is blown at a fixed pressure upon both the end surfaces of the molded body 3.

Next, the surface of the copper wire coil (internal conductor) 2 exposed on the surface of the molded body 3 is smoothed by immersing the molded body 3 in a copper etching solution (ferric chloride stock solution) for about 10 seconds to about 30 seconds. Then, the molded body 3 is washed with an alkaline cleaning agent, such as diluted sulfuric acid (about 5 weight % of $H_2SO_4$), and after having been washed, the molded body 3 is rinsed with an ample amount of water.

Figure 3:
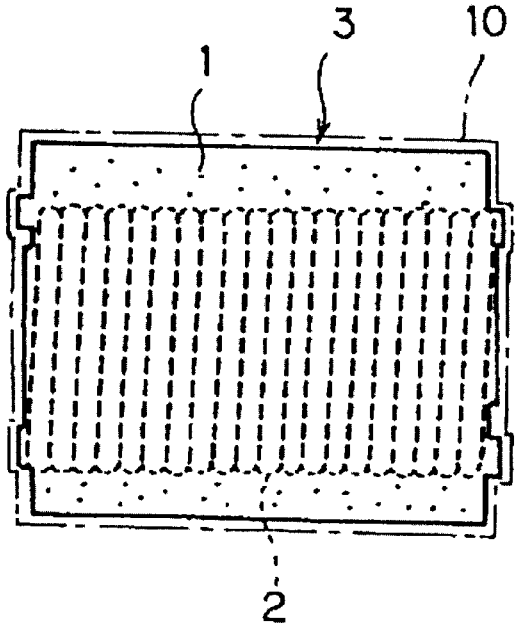
FIG. 3 shows the state in which a palladium catalyst is provided on the surface of the molded body in one process step in the manufacturing method for an electronic component according to the first preferred embodiment of the present invention.

Then, the molded body 3 is immersed for about one minute at room temperature in, for example, a pre-dip solution (mixture of about 20 ml/l of Pre Dip Neoganth B (Atotech Japan K.K.) with about 1 ml/l of sulfuric acid), and then immersed for about five minutes in an alkaline palladium activator solution (solution of about 40 ml/l of Activator Neoganth 834 (Atotech Japan K.K.) with about 5 g/l of boric acid added thereto, the pH of which is adjusted to about 10.5 to about 11.0) which is kept at approximately 40° C. Then, after having been immersed for five minutes in a palladium reduction solution (solution of Reducer Neoganth WA (Atotech Japan K.K.) with about 5 g/l of boric acid added thereto), which is kept at approximately 30° C., the molded body 3 is washed with water for about one minute. In this way, as shown in FIG. 3, metal palladium nuclei are deposited on the entire surface of the molded body 3.

Moreover, the deposition density of the metal palladium nuclei at this time is about 0.05 $\mu g/cm^2$ to about 0.3 $\mu g/cm^2$ on the exposed surface of the copper wire coil 2 (internal conductor's exposed surface) and about 0.5 $\mu g/cm^2$ to about 1.5 $\mu g/cm^2$ on the surface of the ferrite resin 1 (molded body's surface), and thus the metal palladium nuclei 10 are densely deposited on the ferrite resin 1 and thinly deposited on the exposed copper wire coil 2.

Figure 4:
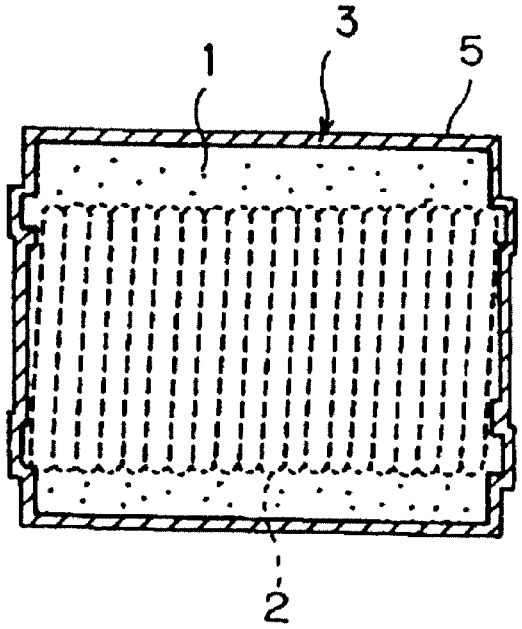
FIG. 4 shows the state in which the surface of the molded body is electroless plated in one process step in the manufacturing method for an electronic component according to the first preferred embodiment of the present invention.

After that, an electroless nickel plating solution (mixture of 100 ml/l of ICP NICORON USD-M (OKUNO CHEMICAL INDUSTRIES CO., LTD) with 50 ml/l of ICP NICORON USD-1 (OKUNO CHEMICAL INDUSTRIES CO., LTD), the pH of which is adjusted to about 5) is maintained at approximately 85° C., the molded body 3 is immersed in the electroless nickel plating solution for about 30 minutes to conduct electroless plating, and, as shown in FIG. 4, a nickel film (electroless plated nickel film) 5 which is about 1 $\mu m$ thick is formed on the entire surface of the molded body 3.

Figure 5:
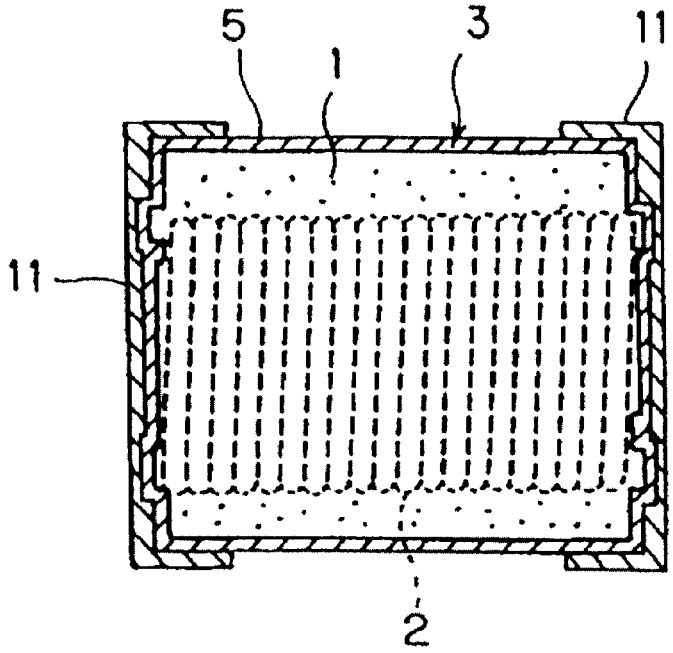
FIG. 5 shows the state in which a portion of the electroless plated surface of the molded body is covered by a resist in one process step in the manufacturing method for an electronic component according to the first preferred embodiment of the present invention.
Figure 6:
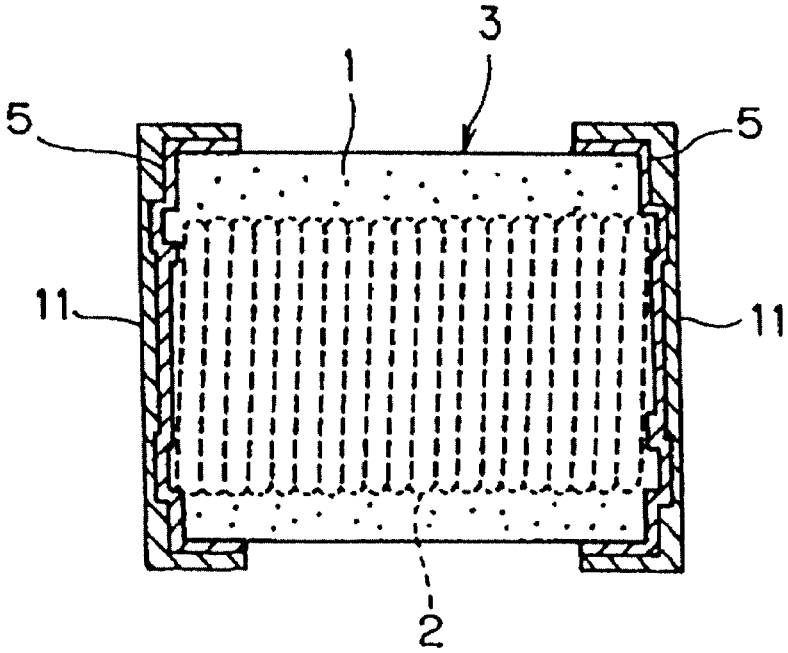
FIG. 6 shows the state in which the electroless plating film in the portion, which is not covered by a resist, of the surface of the molded body has been removed by etching in one process step in the manufacturing method for an electronic component according to the first preferred embodiment of the present invention.

Then, as shown in FIG. 5, necessary portions of the electroless plated nickel film 5 (which will become the external electrodes) are covered by a resist 11, and the unnecessary portions of the electroless plated nickel film 5 are removed with acid. (FIG. 6)

Figure 8:
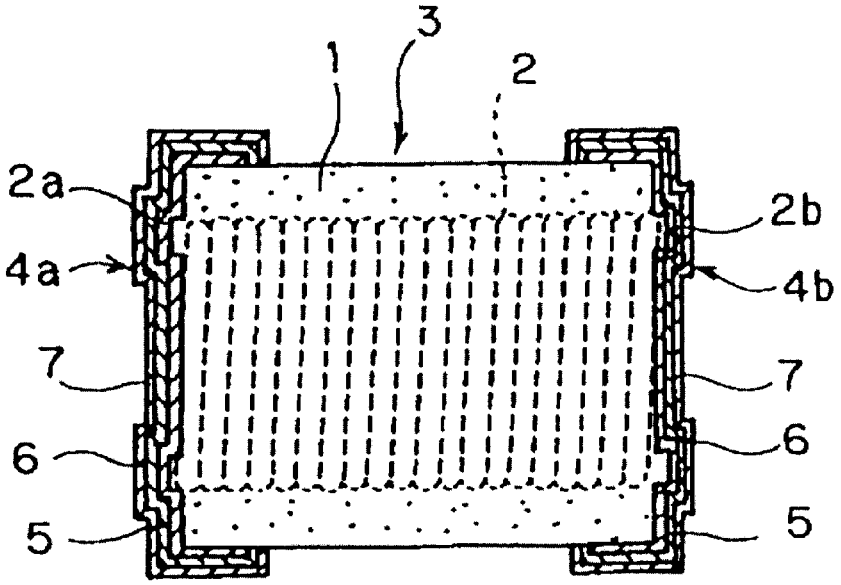
FIG. 8 shows an electronic component (surface mounting type inductor) manufactured by the manufacturing method for an electronic component according to the first preferred embodiment of the present invention.

Next, after the resist 11 has been removed and the molded body 3 has been dried, the electroless plated nickel film 5 left on the molded body 3 is electroplated with nickel and tin, in this order. In this way, as shown in FIG. 8, a surface mounting type inductor is produced that includes the external electrodes 4*a* and 4*b* of a three-layer construction defined by the electroless plated nickel film 5, the electroplated nickel film 6, and the electroplated nickel film 7 provided at the both end portions of the molded body 3.

In this preferred embodiment, since an alkaline palladium ion solution is used, the ratio at which the palladium ion is reduced to the metal palladium on the exposed surface of the internal conductor (copper wire coil) 2 made of copper having a greater ionization tendency than that of the palladium is small.

On the other hand, on the ferrite resin 1 having a much greater degree of surface roughness than the exposed surface of the copper wire coil 2 which was smoothed as described above, palladium ions are more densely deposited on the ferrite resin 1 than on the exposed surface of the copper wire coil 2 due to an anchor effect.

Accordingly, by reducing the palladium ions deposited on the surface of the molded body 3 by using a reducing agent, it is possible to deposit palladium such that the deposition density of palladium is much greater on the ferrite resin 1 than on the exposed copper wire coil 2. Further, in the following electroless nickel plating, it is possible to form a nickel film (electroless plated nickel film) 5 that has excellent adhesion to both the ferrite resin 1 and the exposed copper wire coil 2.

Moreover, when the deposition density exceeds about 0.3 $\mu g/cm^2$ on the copper wire coil 2, the adhesion of the electroless plated nickel film 5 deteriorates, and when the deposition density of palladium is about 0.05 $\mu g/cm^2$ or less, a portion having no electroless plated nickel film is produced. Accordingly, the deposition density is preferably within the range of about 0.05 $\mu g/cm^2$ to about 0.3 $\mu g/cm^2$ on the copper wire coil 2.

Furthermore, when the deposition density of palladium is less than about 0.5 $\mu g/cm^2$ on the ferrite resin 1, the adhesion of the electroless plated nickel film 5 is reduced, and when the deposition density of palladium exceeds about 1.5 $\mu g/cm^2$, the metal palladium nuclei 10 are dissolved in the electroless nickel plating solution to accelerate deterioration of the electroless nickel plating solution, and thus, the cost increases. Accordingly, the deposition density is preferably within the range of about 0.5 $\mu g/cm^2$ to about 1.5 $\mu g/cm^2$ on the ferrite resin 1.

Furthermore, according to the method of the first preferred embodiment, the concentration and viscosity of solutions containing palladium is much more easily controlled as compared with the conventional method. Accordingly, the manufacturing costs are greatly reduced.

Moreover, regarding conventional test samples (finished inductor products) in which palladium is deposited on the ferrite resin 1 and on the exposed copper wire coil 2 to have substantially the same deposition density and test samples (finished inductor products) according to the above-described first preferred embodiment in which palladium is deposited to have a greater density on the ferrite resin 1 than on the surface of the conductor coil 2, the bonding strength was tested to investigate the adhesion of the external electrodes 4*a* and 4*b* (FIG. 8) to the molded body 3. The result is shown in Table 1.

In Table 1, the rate of bonding strength defectives (%) is expressed as a percentage.

TABLE 1

| | Deposition density of Pd ($\mu g/cm^2$) | | Rate of bonding strength defectives (%) | |
|---|---|---|---|---|
| | Surface of ferrite resin | Surface of copper wire coil | Surface of ferrite resin | Surface of copper wire coil |
| 1 (Conventional) | Dense (1.8) | Dense (1.8) | 3 | 100 |
| 2 (Conventional) | Dense (1.5) | Dense (1.5) | 1 | 85 |
| 3 (Conventional) | Dense (0.5) | Dense (0.5) | 2 | 43 |
| 4 (Conventional) | Thin (0.3) | Thin (0.3) | 32 | 2 |
| 5 (Conventional) | Thin (0.05) | Thin (0.05) | 78(*) | 1(*) |
| 6 (Embodiment) | Dense (0.5) | Thin (0.05) | 1 | 1(*) |
| 7 (Embodiment) | Dense (0.7) | Thin (0.1) | 0 | 0 |
| 8 (Embodiment) | Dense (0.9) | Thin (0.15) | 0 | 0 |
| 9 (Embodiment) | Dense (1.2) | Thin (0.2) | 0 | 0 |
| 10 (Embodiment) | Dense (1.5) | Thin (0.3) | 0 | 1 |

(*)Occurrence of deposition defectives

Moreover, for the bonding strength test, when the test samples (inductors) are placed on a hot plate which is heated to a temperature of approximately 250° C. for about ten minutes, the test samples in which the external electrodes were floating or a partial separation occurred were judged to be defective in bonding strength.

As clearly seen in Table 1, in the conventional test samples (inductors) numbered 1 to 5, when the deposition density of palladium is in the range of about 0.5 $\mu g/cm^2$ to about 1.5 $\mu g/cm^2$ on the ferrite resin 1, the bonding strength of the external electrodes to the ferrite resin is outstanding, and when the deposition density of palladium is in the range of about 0.05 $\mu g/cm^2$ to about 0.3 $\mu g/cm^2$ on the conductor coil, the bonding strength of the external electrodes to the conductor coil is outstanding. However, it is understood that it is very difficult to have outstanding bonding strength of the external electrodes to both the ferrite resin and the conductor coil at the same time. On the contrary, in the test samples (inductors) numbered 6 to 10 according to preferred embodiments of the present invention, the bonding strength of the external electrodes to both the ferrite resin and the conductor coil is outstanding.

In preferred embodiment 2, a case in which only the surface of the molded body is roughened by immersing the molded body in an organic solvent is described.

Step 1

First, the same molded body as that in the above preferred embodiment of FIG. 1, that is, the molded body 3 which measures, for example, approximately 4.5 mm×3.2 mm×3.2 mm, wherein the copper wire coil 2 having a wire diameter of, for example, about 0.2 mm, a coil inner diameter of, for example, about 1.8 mm, and a coil length of, for example, about 3.2 mm is embedded inside the ferrite resin (magnetic core) 1 in which ferrite powder including $Fe_2O_3$, NiO, CuO, and ZnO and a PPS (polyphenylene sulfide) resin are mixed and kneaded, is prepared.

Step 2

Figure 9:
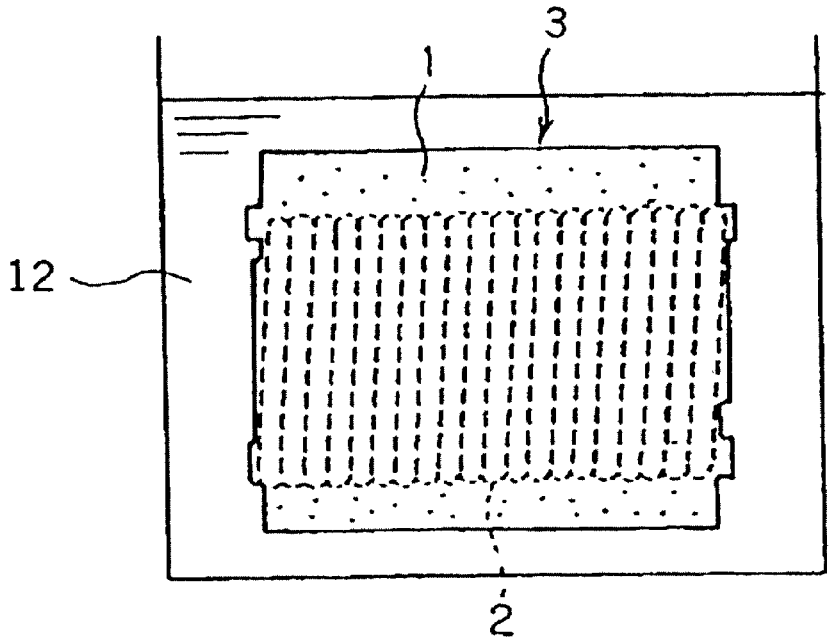
FIG. 9 shows the state in which the molded body is immersed in an organic solvent containing acetone as the main component to roughen the surface of the molded body in a manufacturing method for an electronic component according to a second preferred embodiment of the present invention.
Figure 10:
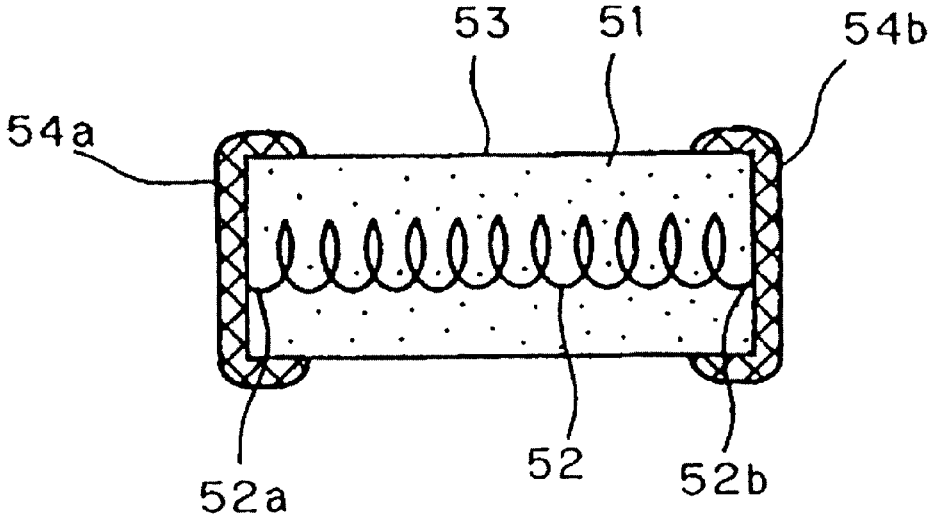
FIG.10 PRIOR ART
FIG. 10 is a sectional view showing the construction of a conventional surface mounting type inductor.

Then, as shown in FIG. 9, the molded body 3 is immersed in an organic solvent 12 containing acetone as the main component for a time of about 1 minutes to about 5 minutes and the surface of the ferrite resin 1 is roughened by chemical corrosion, and thus microscopic asperities are formed on the surface of the ferrite resin 1 (molded body 3). Moreover, at this time, the exposed surface of the copper wire coil 2 is not corroded by the organic solvent 12 and no asperities are formed on the surface of the coil 2.

Step 3

Next, after having been washed with an alkaline cleaning agent and dilute sulfuric acid (approximately 5 weight % of $H_2SO_4$), the molded body 3 is rinsed with an ample amount of water.

Step 4

Figure 7:
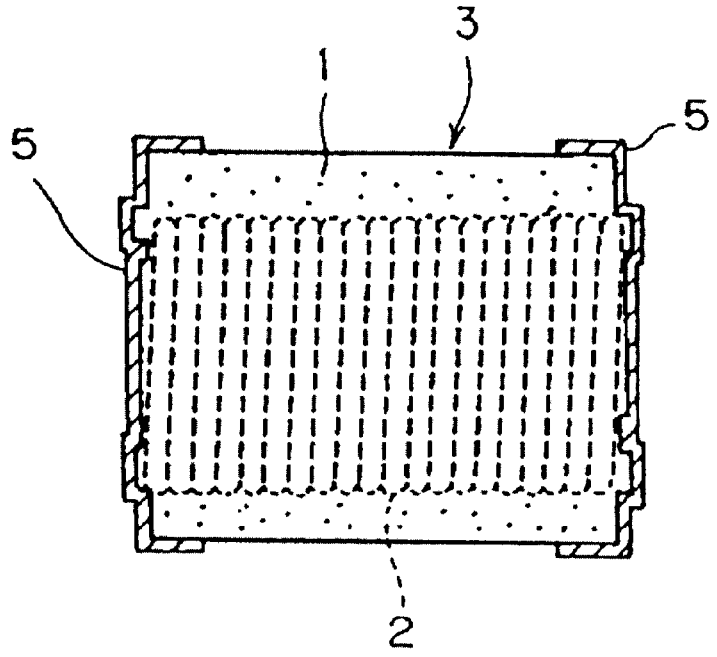
FIG. 7 shows the state in which, after the unnecessary portion of the electroless plating film was removed by etching, the resist is removed in one process step in the manufacturing method for an electronic component according to the first preferred embodiment of the present invention.

Then, in the same way as in steps 4 to 7 of the above preferred embodiment 1, after palladium has been deposited on the surface of the molded body 3 so as to be dense on the ferrite resin and thin on the exposed copper wire coil 2 (see FIG. 3), and then electroless nickel plating is performed (see FIG. 4) and then after necessary portions of the electroless plated nickel film 5 have been covered by a resist 11 (see FIG. 5) and the unnecessary portions of the electroless plated nickel film 5 have been removed by acid (see FIG. 6), the resist 11 is removed (FIG. 7) and the electroless plated nickel film 5 left on the molded body 3 is electroplated with nickel and tin in this order. Thus, as shown in FIG. 8, a surface mounting type inductor in which the external electrodes 4*a* and 4*b* of a three-layer construction, which includes the electroless plated nickel film 5, the electroplated nickel film 6, and the electroplated nickel film 7, are provided can be obtained.

In a second preferred embodiment of the present invention, the ratio at which the palladium ion is reduced to the metal palladium on the exposed surface of the internal conductor (copper wire coil) 2 made of copper having a greater ionization tendency than that of the palladium is small, and on the ferrite resin 1 having a much greater degree of surface roughness than the exposed surface of the copper wire coil 2, palladium ions are more densely deposited than on the exposed surface of the copper wire coil 2 due to the anchor effect.

Therefore, by reducing the palladium ions deposited on the surface of the molded body 3 using a reducing agent, it is possible to deposit palladium such that the density of palladium on the ferrite resin 1 is greater than on the exposed copper wire coil 2. Further, in the electroless nickel plating that follows, it is possible to form a nickel film (electroless plated nickel film) 5 that has excellent adhesion to both the ferrite resin 1 and the exposed copper wire coil 2.

Furthermore, in the second preferred embodiment, when compared with the conventional method, it is much easier to control the concentration and viscosity of solutions containing palladium. Accordingly, the manufacturing costs are greatly reduced.

Moreover, in the second preferred embodiment, an acetone-group organic solvent was used to roughen the surface of the ferrite resin 1 by chemical corrosion. However, various organic solvents may be used which do not change the exposed surface of the copper wire coil 2 and only corrode the surface of the ferrite resin 1.

Furthermore, in the above-described first and second preferred embodiments, an electroless plated nickel film was formed as a metal film. However, electroless plating films of other metals (for example, copper) that are catalyzed by palladium may be used as a metal film.

Furthermore, in the first and second preferred embodiments, external electrodes having a three-layer construction defined by the electroless plated nickel film, the nickel electroplating film, and the tin electroplating film were described. However, the construction of the external electrodes is not particularly limited. The external electrodes may have a single-layer construction or of a multiple-layer construction. Further, the number of layers and combinations of each of the layers when the external electrodes are made of a multiple-layer construction may be modified.

Furthermore, in the above-described first and second preferred embodiments, a surface mounting type inductor is described as an example of an electronic component manufactured according to preferred embodiments of the present invention. However, the present invention can be applied to various electronic components such as laminated capacitors, laminated varistors, composite LC parts, and other suitable electronic components.

While preferred embodiments of the invention have been described above, it is to be understood that variations and modifications will be apparent to those skilled in the art without departing the scope and spirit of the invention. The scope of the invention, therefore, is to be determined solely by the following claims.

What is claimed is:

1. An electronic component comprising:

an internal conductor including a metal embedded in a molded body defined by molding an insulative material including a resin or rubber as the main component into a desired shape such that at least a portion of the internal conductor is exposed on the surface of the molded body; and external electrodes which are electrically connected to the internal conductor and which are provided in a desired area, including the area where the internal conductor is exposed, on the surface of the molded body; wherein palladium is present at a deposition density of about 0.5 $\mu g/cm^2$ to about 1.5 $\mu g/cm^2$ on the surface of the molded body where the external electrodes are provided except at the area where the internal conductor is exposed;

palladium is present at a deposition density of about 0.05 $\mu g/cm^2$ to about 0.3 $\mu g/cm^2$ on the internal conductor exposed on the surface of the molded body; and a metal film, which defines at least a portion of the external electrode, is electroless plated in the area where the palladium is deposited.

2. An electronic component as set forth in claim 1, wherein two end portions of the internal conductor are exposed on the surface of the molded body and a pair of external electrodes are arranged to be electrically connected to both of said two end portions.

3. An electronic component as set forth in claim 1, wherein the insulative material includes a magnetic powder that is mixed with the resin or rubber.

4. An electronic component as set forth in claim 1, wherein the internal conductor comprises a coil conductor in which a metal wire is spirally wound.

5. An electronic component as set forth in claim 1, wherein the internal conductor is made of at least one material selected from a group consisting of Cu, Ag, Al, Ni, and alloys thereof.

6. An electronic component as set forth in claim 1, wherein the metal film is an electroless plated nickel film.

7. An electronic component as set forth in claim 1, wherein the metal film is an electroless plated copper film.

8. An electronic component as set forth in claim 1, wherein the external electrodes comprise a three-layer construction including three electroplated nickel films.

9. An electronic component as set forth in claim 1, wherein the external electrodes comprise a single layer construction of an electroplated nickel film.

* * * * *